United States Patent [19]

Pfohl

[11] 4,215,433

[45] Aug. 5, 1980

[54] BURGEE APRON

[76] Inventor: Martha C. Pfohl, P.O. Box 624, San Rafael, Calif. 94901

[21] Appl. No.: 67,326

[22] Filed: Aug. 17, 1979

[51] Int. Cl.[2] ..... A41B 13/00

[52] U.S. Cl. ..... 2/48

[58] Field of Search ..... 2/46–52

[56] References Cited

U.S. PATENT DOCUMENTS

| | | | |
|---|---|---|---|
| 1,967,369 | 7/1934 | Repitsky | 2/48 |
| 2,051,142 | 8/1936 | Hovey | 2/48 |
| 2,620,476 | 12/1952 | Kalsall | 2/48 |

*Primary Examiner*—Doris L. Troutman

*Attorney, Agent, or Firm*—Melvin R. Stidham

[57] ABSTRACT

An apron comprising large and small, generally truncated triangular, burgee flags bearing an insignia of a yacht club or the like. The large flag is worn with the base of the triangle uppermost to form the bib of an apron. Grommets are provided in both aprons along the sides thereof, at the top and bottom of the small flag and at the top and midway of the length of the large flag, and lengths of nautical line connect opposing grommets, front to back. The small flag may be arranged with the triangular base at the shoulders or inverted to form the back waistband, as best suited to the waist measurement of the wearer.

6 Claims, 5 Drawing Figures

BURGEE APRON

BACKGROUND OF THE INVENTION

Aprons available for outdoor cooking and entertainment are commonly provided with clever or attractive material patterns, but are generally of the conventional, commonly accepted bib configuration.

OBJECTS OF THE INVENTION

It is an object of this invention to provide an apron which is unique and interesting in both pattern design and configuration.

It is a further object of this invention to provide a unique apron which would be particularly appealing to members of a yacht club or like association.

It is a further object of this invention to provide an apron for entertaining which is adjustable for a wide range of sizes.

Other objects and advantages of this invention will become apparent from the description to follow, particularly when read in conjunction with the accompanying drawing.

SUMMARY OF THE INVENTION

In carrying out this invention, I provide a pair of burgee flags, each with the insignia of a yacht club or the like. The larger burgee is long enough to cover the chest and upper legs of the wearer and is worn with the base of the triangle uppermost to extend from shoulder to shoulder. Grommets are provided along the edges of the large burgee at the top and intermediate the top and bottom. The small burgee is worn in the back and may be worn with the base of the triangle at the waist or at the shoulders, depending upon which provides the better fit. Grommets along the sides of the small burgee at the top and bottom are substantially at the horizontal level of the grommets of the front, larger burgee. Lengths of nautical line extend between opposing grommets and may be knotted to adjust to size.

DESCRIPTION OF A PREFERRED EMBODIMENT

Figure 2:
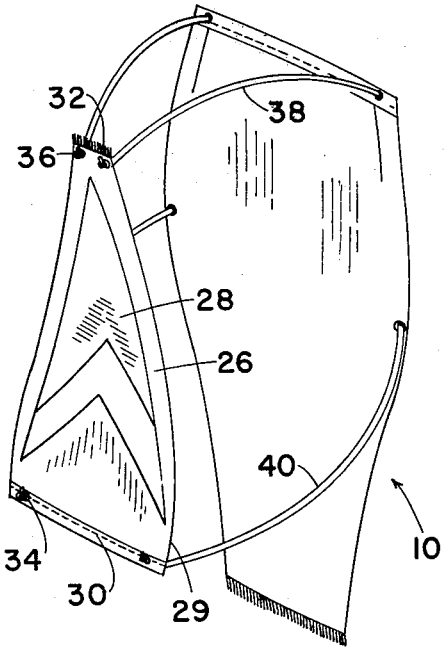
FIG. 2 is a view in perspective taken from the rear and same side; but with back panel inverted.

Referring now to the drawing with greater particularity, the apron 10 of this invention includes a front panel 12 of generally traingular configuration, though preferably truncated at 14 so as not to be unduly long. In addition the truncated edge 15 may have a frayed affect to give a weather-beaten appearance. The panel 12 is in the form of a burgee and may include suitable insignia 16 representative of a yacht club, sailing group or the like.

While a true truncated triangle has proven satisfactory, I have found it advantageous, in order to insure sufficient width at the waist without excessive width at the shoulders to taper the side edges away at 18 to deviate somewhat from the triangular configuration. Preferable a tape 20 is provided along the top edge of the panel 12 for improved wear, and gromments 22 and 24 are provided along the side edges at the top 20 and, in the waist area, intermediate the top 20 and bottom 14. A second panel 26 of smaller truncated triangular configuration forms the back of the apron. The smaller panel 26 is similarly provided with an insignia 28 to represent a burgee and , for uniformity may also be tapered away at 29. The back panel 26 is provided with water tape 30 along the base of the triangle and is similarly truncated at 32. Again, grommets 34 and 36 are provided along the side edges at the base 30 and smaller edge 32. Two lengths of nautical line extend between the top grommets 22 of the front panel 12 to either the grommets 34 or 35 of the back panel 26, depending upon whether the base 30 of the back panel is placed at the top or the bottom. A second pair of lines 40 extend between the grommets 24 and the other pair of grommets of the back panel (grommets 36 in FIG. 1 and grommets 34 in FIG. 2).

Figure 1:
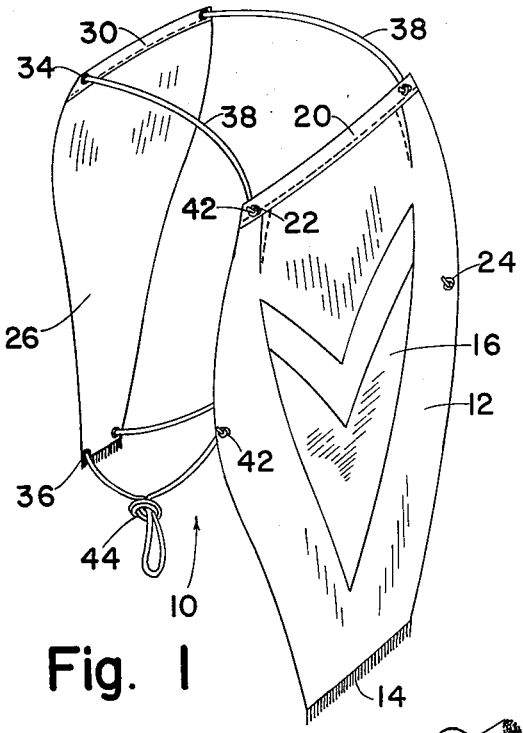
FIG. 1 is a view in perspective of the apron of this invention taken from the front and one side.
Figure 3:
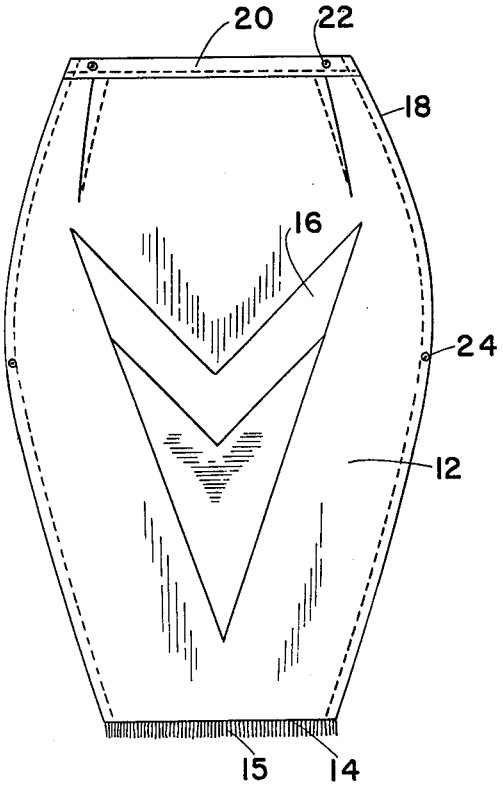
FIGS. 3 and 4 are plan views of the front and rear panels, respectfully.
Figure 5:
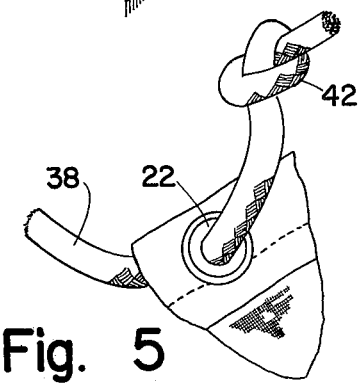
FIG. 5 is a partial view in perspective showing the adjustment of an interconnecting line.
Figure 4:
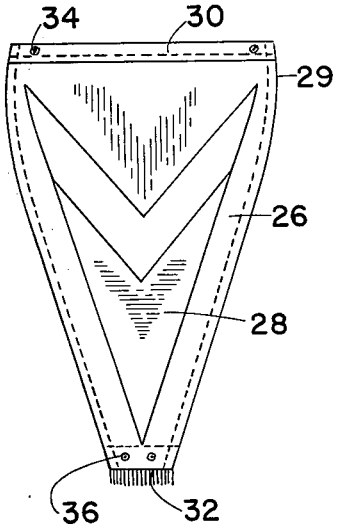

The lines 38 and 40 are secured in place as by tying off the ends at 42 (FIG. 5) and, in addition, size adjustment can be made by pulling the lines snug and tying them off in loops, as shown at 44 (FIG.1).

The invertable back panel 26 gives greater flexibility and range of adjustment. That is, for a stout person, the back burgee 26 may be inverted as shown in FIG. 2 to provide larger total waist band and, for a slim person, the burgee may be worn as shown in FIG. 1.

While this invention has been described in conjunction with a preferred embodiment, it is obvious that modifications and changes therein may be made by those skilled in the art without departing from the spirit and scope of this invention, as defined by the claims appended hereto.

What is claimed as invention is:

1. An apron comprising:

a large panel with a small panel each of truncated, generally triangular configuration and of flexible sheet material;

said large panel being inverted with the triangle base uppermost to form the bib of an apron;

first and second pairs of openings in said large panel along the sides thereof, said first pair being disposed at the top thereof and said second pair being disposed intermediate the top and bottom thereof;

third and fourth pairs of openings in said small panel along the sides thereof adjacent to the top and bottom thereof, respectively; and cords interconnecting said first pair of openings with one of said third and fourth pairs, and cords connecting said second pair of openings with the other of said thrid and fourth pairs.

2. The apron defined by claim 1 wherein:

a selected one of said third and fourth pairs may be aligned horizontally with said first pair of openings.

3. The apron defined by claim 1 including:

insignia on said large panel representative of a burgee.

4. Apron defined by claim 1 including:

insignia on said small panel representative of a burgee.

5. The apron defined by claim 1 wherein said cords comprise:

lengths of marine line.

6. The apron defined by claim 1 including:

grommets surrounding said openings.

* * * * *